US011282480B2

(12) United States Patent
Furihata et al.

(10) Patent No.: US 11,282,480 B2
(45) **Date of Patent: *Mar. 22, 2022**

(54) DEVICE AND METHOD FOR DISPLAY BRIGHTNESS CONTROL

(71) Applicant: SYNAPTICS INCORPORATED, San Jose, CA (US)

(72) Inventors: Hirobumi Furihata, Tokyo (JP); Kazutoshi Aogaki, Tokyo (JP); Tomoo Minaki, Tokyo (JP); Akio Sugiyama, Tokyo (JP); Takashi Nose, Tokyo (JP)

(73) Assignee: Synaptics Incorporated, San Jose, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/027,229

(22) Filed: Sep. 21, 2020

(65) Prior Publication Data

US 2021/0012749 A1 Jan. 14, 2021

Related U.S. Application Data

(63) Continuation of application No. 16/176,246, filed on Oct. 31, 2018, now Pat. No. 10,783,850.

(30) Foreign Application Priority Data

Nov. 2, 2017 (JP) ..... 2017-213278

(51) Int. Cl.

| | |
|---|---|
| ***G09G 5/10*** | (2006.01) |
| ***G09G 3/3208*** | (2016.01) |
| ***G09G 3/36*** | (2006.01) |
| *G09G 3/20* | (2006.01) |

(52) U.S. Cl.

CPC ..... *G09G 5/10* (2013.01); *G09G 3/3208* (2013.01); *G09G 3/36* (2013.01); *G09G 3/2074* (2013.01); *G09G 2310/027* (2013.01); *G09G 2310/0286* (2013.01); *G09G 2320/0276* (2013.01);

(Continued)

(58) Field of Classification Search

USPC ..... 345/690, 694, 212, 691, 692, 89, 600

See application file for complete search history.

(56) References Cited

U.S. PATENT DOCUMENTS

| | | | | |
|---|---|---|---|---|
| 6,611,249 | B1 | 8/2003 | Evanicky et al. | |
| 2003/0122761 | A1* | 7/2003 | Hong | G09G 3/2011 345/89 |
| 2004/0036708 | A1 | 2/2004 | Evanicky et al. | |

(Continued)

FOREIGN PATENT DOCUMENTS

JP 2016035578 A 3/2016

*Primary Examiner* — Thuy N Pardo

(74) *Attorney, Agent, or Firm* — Ferguson Braswell Fraser Kubasta PC

(57) ABSTRACT

A display driver includes gamma curve control circuitry and a converter controller. The gamma curve control circuitry is configured to generate a first gamma curve for a first display brightness value (DBV), and a second gamma curve for a second DBV lower than the first DBV. The converter controller is configured to control a digital-analog converter (DAC) configured to perform digital-analog conversion of an input image data. Further, the converter controller is configured to adjust an analog signal voltage amplitude of the DAC based on a range of an output voltage associated with the second gamma curve.

21 Claims, 7 Drawing Sheets

(52) U.S. Cl.
CPC ..... *G09G 2320/064* (2013.01); *G09G 2320/0673* (2013.01)

(56) References Cited

U.S. PATENT DOCUMENTS

| | | | | |
|---|---|---|---|---|
| 2007/0085816 | A1 | 4/2007 | Evanicky et al. | |
| 2007/0132689 | A1 | 6/2007 | Li et al. | |
| 2008/0111836 | A1 | 5/2008 | Huang et al. | |
| 2010/0039454 | A1* | 2/2010 | Nakamura | G09G 3/3233 345/690 |
| 2010/0045690 | A1 | 2/2010 | Handschy et al. | |
| 2012/0075320 | A1 | 3/2012 | Handschy et al. | |
| 2012/0236262 | A1 | 9/2012 | Johansson | |
| 2013/0113842 | A1 | 5/2013 | Hwang et al. | |
| 2013/0127817 | A1 | 5/2013 | Hwang et al. | |
| 2014/0055326 | A1 | 2/2014 | Lai | |
| 2014/0055503 | A1 | 2/2014 | Jung et al. | |
| 2014/0125690 | A1* | 5/2014 | Kanzaki | G09G 3/36 345/600 |
| 2014/0333605 | A1* | 11/2014 | Hasegawa | G09G 3/3225 345/212 |
| 2015/0179116 | A1* | 6/2015 | Syu | G09G 3/3648 345/690 |
| 2015/0310796 | A1 | 10/2015 | Hwang et al. | |
| 2016/0111050 | A1* | 4/2016 | Pyun | G09G 3/3688 345/694 |
| 2016/0189347 | A1 | 6/2016 | Hu et al. | |
| 2017/0047019 | A1* | 2/2017 | Li | G09G 3/2092 |
| 2017/0069244 | A1 | 3/2017 | Lim et al. | |
| 2017/0140713 | A1* | 5/2017 | Liu | G09G 3/3648 |
| 2018/0182318 | A1 | 6/2018 | Xing et al. | |
| 2019/0079662 | A1* | 3/2019 | Wan | G06F 3/016 |

* cited by examiner

DEVICE AND METHOD FOR DISPLAY BRIGHTNESS CONTROL

CROSS REFERENCE

This application is a continuation of U.S. patent application Ser. No. 16/176,246 filed Oct. 31, 2018, which claims priority to Japanese Patent Application No. 2017-213278, filed on Nov. 2, 2017, the disclosure of which are incorporated herein by reference in their entirety.

BACKGROUND

Field

The present disclosure relates to a display driver, a display device and brightness control method.

Description of the Related Art

Display panels, such as liquid crystal display panels and organic light emitting diode display panels, are used in electronic appliances such as notebook computers, desktop computers and smart phones. A display driver for driving a display panel may be configured to control a display brightness level by adjusting output voltages and light emitting time.

SUMMARY

In one or more embodiments, a display driver includes gamma curve control circuitry configured to generate a first gamma curve for a first display brightness value (DBV), and a second gamma curve for a second DBV lower than the first DBV; and a converter controller configured to control a digital-analog converter (DAC) configured to perform digital-analog conversion of an input image data. The converter controller is configured to adjust an analog signal voltage amplitude of the DAC which performs the digital-analog conversion, based on a range of an output voltage associated with the second gamma curve.

In one embodiment, a display device comprises a display panel and a display driver. The display driver is configured to drive the display panel and comprises gamma curve control circuitry and a converter controller. The gamma curve control circuitry is configured to generate a first gamma curve for a first DBV, and a second gamma curve for a second DBV lower than the first DBV. The converter controller is configured to adjust an analog signal voltage amplitude of a DAC based on a range of an output voltage associated with the second gamma curve, wherein the DAC is configured to perform digital-analog conversion of an input image data.

In on embodiment, a method for controlling a display brightness level comprises generating a first gamma curve for a first DBV. The method comprises, when a DBV of a display device is set to a second DBV lower than the first DBV, controlling a second gamma curve generated for the second DBV, an analog signal voltage amplitude of a DAC, and light emitting time of pixels of a display panel. The DAC is configured to perform digital-analog conversion on an input image data.

BRIEF DESCRIPTION OF THE DRAWINGS

So that the manner in which the above recited features of the present disclosure may be understood in detail, a more particular description of the disclosure, briefly summarized above, may be had by reference to embodiments, some of which are illustrated in the appended drawings. It is to be noted, however, that the appended drawings illustrate only some embodiments of this disclosure and are therefore not to be considered limiting of its scope, for the disclosure may admit to other equally effective embodiments.

DETAILED DESCRIPTION

In the following, a detailed description is given of various embodiments with reference to the drawings. It would be apparent that technologies disclosed herein may be implemented by a person skilled in the art without a further detailed description of these embodiments. For simplicity, details of well-known features are not described in the following.

Figure 1:
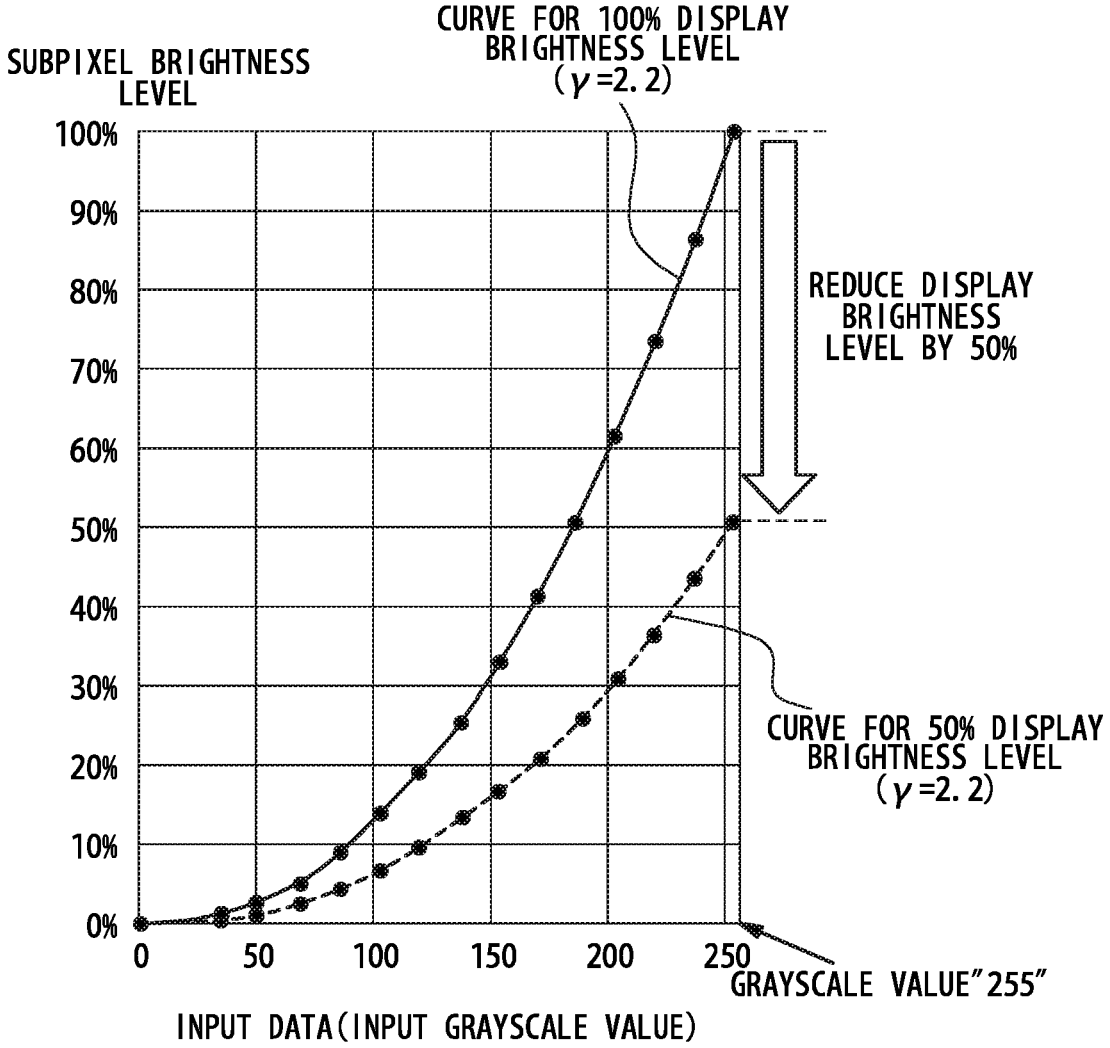
FIG. 1 illustrates an example input data-brightness property, according to one or more embodiments.

In one or more embodiments, as illustrated in FIG. 1, an input data-brightness property represents a relation between an input image data and a subpixel brightness level and has non-linearity called gamma property. When the input data specifies a grayscale value for a specific color (e.g., red, green and blue) of a specific pixel, the subpixel brightness level of the specific color of the specific pixel in a display panel of a display device is proportional to the $\gamma^{th}$ power of the input grayscale value, where $\gamma$ is the parameter called gamma value. In one or more embodiments, the gamma value $\gamma$ is set to, for example, 2.2, for a display panel such as a liquid crystal display panel and an organic light emitting diode (OLED) display panel. In other embodiments, the gamma value $\gamma$ may be set to other values.

The curve for 100% display brightness level in FIG. 1 illustrates the input data-brightness property in accordance with the gamma value of 2.2, according to some embodiments. The display brightness level may be the overall brightness level of an image displayed on the display panel. In one or more embodiments, for example, the curve for 50% display brightness level with a 2.2 gamma value may be achieved as follows. In one or more embodiments, for a 2.2 gamma value, the subpixel brightness level is proportional to the $2.2^{th}$ power of the input grayscale value. Accordingly, the curve in accordance with the gamma value of 2.2 for the display brightness level of 50% may be calculated as $0.5\times(\text{input data})^{2.2}=(0.5^{1/2.2}\times\text{input data})^{2.2}=(186.0/255\times\text{input data})^{2.2}$. In one embodiment, the input data-brightness property in accordance with the gamma value of 2.2 for the display brightness level of 50% may be achieved by multiplying the curve for 100% display brightness level by 186/255. In one or more embodiments, when the display brightness level is reduced by 50%, the allowed number of the input grayscale values may become 186/255 times (or about 72.9%), reducing the number of grayscale levels usable to reproduce the display image. In such an embodiment, grayscale collapse may occur.

In one or more embodiments, the display brightness level is reduced without reducing the number of grayscale levels usable to reproduce the display image. In one embodiment, a first gamma curve in accordance with a given gamma value, for example, a gamma value of 2.2, is generated with respect to a maximum display brightness value (DBV). When the DBV is reduced, a second gamma curve is generated for the reduced DBV based on the first gamma curve. Further, an analog signal voltage amplitude of a digital-analog converter (DAC) and light emitting time of pixels of the display panel may be controlled. In one or more embodiments, the DAC may be configured to perform digital-analog conversion on an image data inputted thereto.

Figure 2:
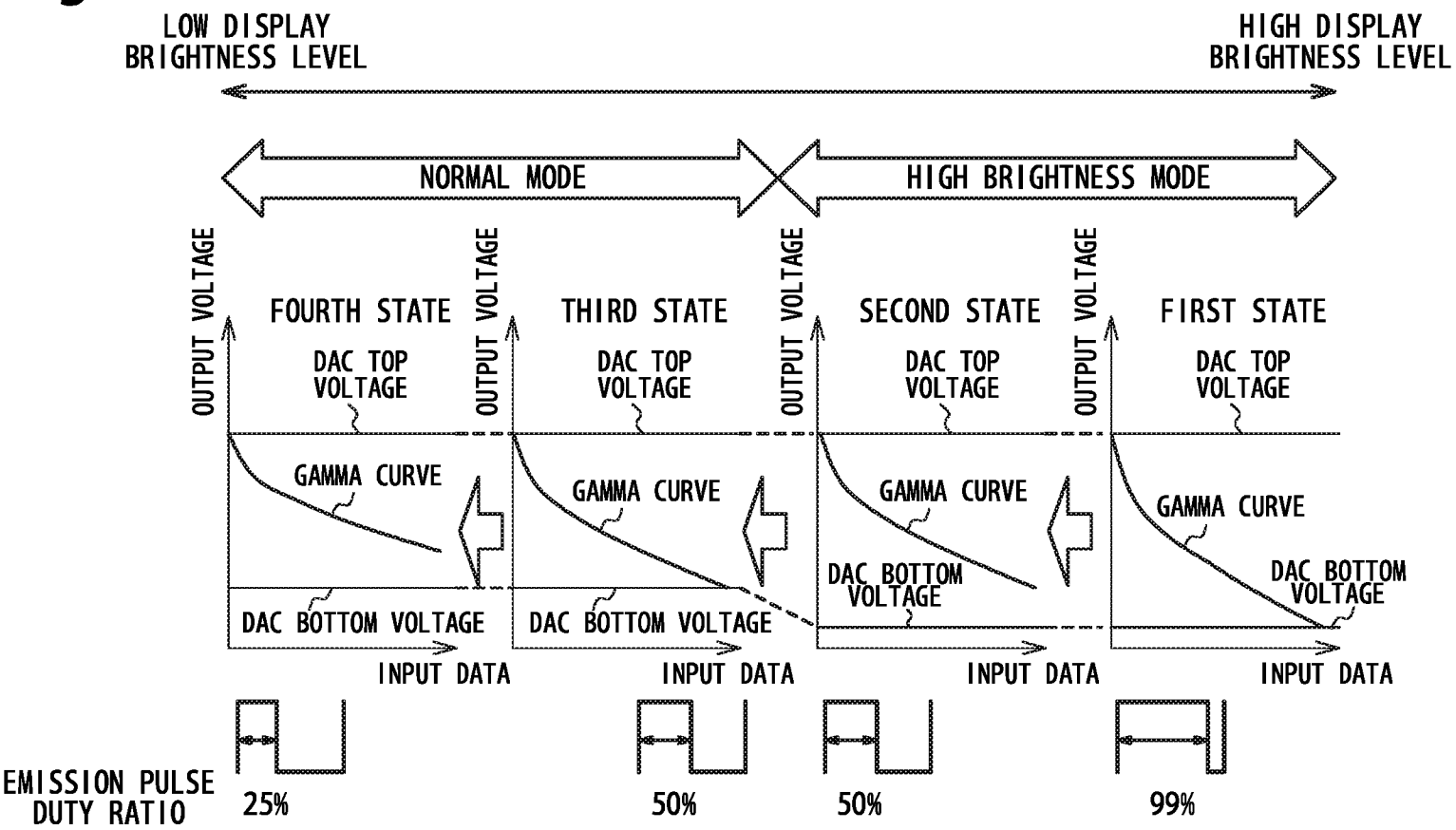
FIG. 2 illustrates example control of display brightness levels, according to one or more embodiments.

The graphs illustrated in FIG. 2 indicate the correspondence relationships between the input data and the output voltage generated through gamma correction and digital-analog conversion for first to fourth states, according to one or more embodiments. The curves illustrated in FIG. 2 represent gamma curves in accordance with a given gamma value γ, for example, a gamma value of 2.2.

In one embodiment, for each of the first to fourth states, the top voltage and bottom voltage of a DAC are illustrated. In one embodiment, the DAC has a linear input-output property configured to convert the input digital data into an output analog signal voltage. In one or more embodiments, an output voltage of the DAC is selected from analog signal voltages V0 to V1023, which may be associated with, for example, 10-bit grayscale values "0" to "1023", respectively. In one or more embodiments, the top voltage of the DAC is the highest one of the voltages V0 to V1023, for example, the voltage V0, and the bottom voltage is the lowest one of the voltages V0 to V1023, for example the voltage V1023. The difference between the top voltage and bottom voltage of the DAC may be referred to as the analog signal voltage amplitude of the DAC. In one or more embodiments, the analog signal voltage amplitude of the DAC is proportional to the display brightness level. In one or more embodiments, the display brightness level decreases as the analog signal voltage amplitude of the DAC decreases.

In one embodiment, an emission pulse duty ratio is indicated for each of the first to fourth states, which is defined as the ratio of the light emitting time of pixels of a display panel in the display device to the time duration of one frame period. In various embodiments, the emission pulse specifies the time duration of the light emitting time of pixels. The display brightness level may decrease as the emission pulse duty ratio decreases. The minimum pulse width of the emission pulse may correspond to the time duration of one horizontal sync period, during which one scan line of the display panel is driven. The number of scan lines is 1920, for full high definition (FHD).

In the example illustrated in FIG. 2, the first and second states are defined for a high brightness mode, and the third and fourth states are defined for a low brightness mode. In the first state, the display brightness level is set to the allowed maximum display brightness level, and the display brightness level is successively reduced in the second, third and fourth states in this order.

In the first state, in which the display brightness level is the highest, the analog signal voltage amplitude of the DAC and the allowed maximum output voltage and allowed minimum output voltage in accordance with the gamma curve are larger than those for the second to fourth states. In the first state, the emission pulse duty ratio is larger than those in the second to fourth states. The gamma value of the gamma curve in the first state is set, for example, to 2.2.

In the second state, in which the display brightness level is lower than that in the first state, the emission pulse duty ration is reduced, for example, to 50%. In the second state, a gamma curve is generated to reduce the display brightness level based on the gamma curve defined for the first state with the gamma value unchanged from the first state. The generation of the gamma curve will be described later. In one or more embodiments, as illustrated in FIG. 1, the range of the output voltage generated in accordance with the gamma curve generated for the second state, that is, the difference between the allowed maximum output voltage and the allowed minimum output voltage is reduced compared to the first state. The top voltage and bottom voltage of the DAC in the second state are unchanged from those in the first state.

In the third state, the emission pulse duty ratio is kept at 50%, as is the case with the second state. In the third state, the analog signal voltage amplitude of the DAC is reduced from that in the second state. In the third state, the range of the output voltage generated in accordance with the gamma curve is equal to the analog signal voltage amplitude of the DAC. The analog signal voltage amplitude of the DAC is adjusted to match the range of the output voltage generated in accordance with the gamma curve in the third state. In the third state, the image is displayed by fully using the analog signal voltage amplitude of the DAC. The shape of the gamma curve generated in the third state is substantially equal to that of the gamma curve generated in the second state; in the third state, the gamma correction is performed so that the gamma curve is substantially unchanged from the second state. Since the shape of the gamma curve remains substantially unchanged, the input data-brightness property may be maintained even when the analog signal voltage amplitude of the DAC is changed.

In one or more embodiments, the emission pulse duty ratio is reduced, for example, from 50% to 25% in the fourth state. Additionally, in the fourth state, the gamma curve may be generated from that defined for the first state to reduce the display brightness level, while the gamma value is unchanged from the first state. The range of the output voltage generated in accordance with the gamma curve may be reduced from the third state. In one or more embodiments, the top voltage and bottom voltage of the analog signal voltage range of the DAC remain unchanged from the third state.

In various embodiments, as described above, the control of the emission pulse, the control of the top voltage and bottom voltage of the DAC, and the generation of the gamma curve are performed responsive to the desired display brightness level by using the gamma curve defined for the maximum display brightness level. As a result, the display brightness level may be smoothly controlled, while maintaining the resolution of the display image. In one or more embodiments, the display brightness level is controlled without using lookup tables (LUTs) describing the relationship between the input data and the output voltage for the respective allowed display brightness levels, and this suppresses an increase of the memory used to store the LUTs, avoiding an increase in the circuit size.

Figure 3:
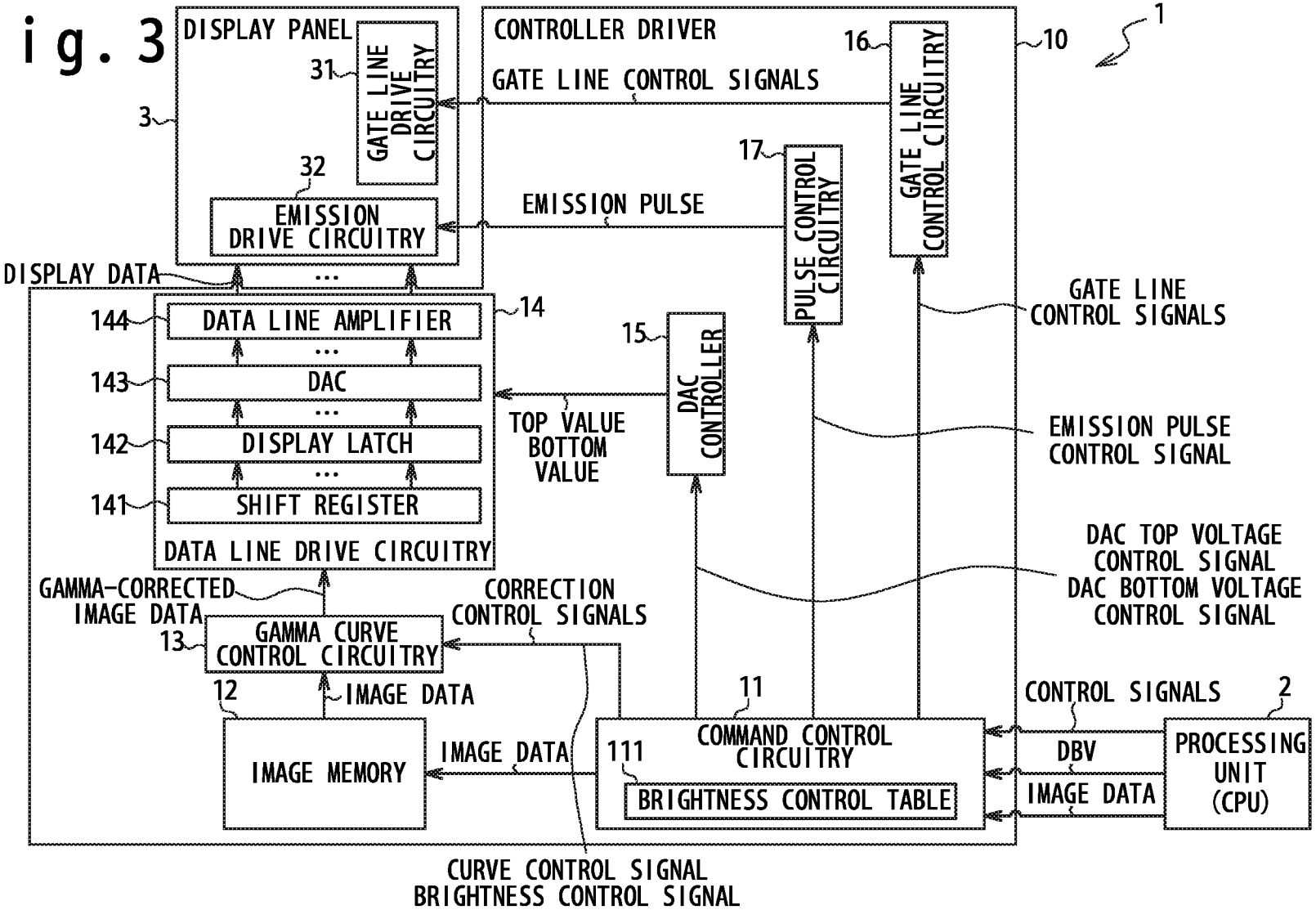
FIG. 3 illustrates an example configuration of a display device, according to one or more embodiments.

In one or more embodiments, as illustrated in FIG. 3, a display device 1 is configured to display images based on image data, control signals and a DBV received from a processing unit 2. The DBV may include display brightness information specifying the display brightness level.

In one or more embodiments, the display device 1 includes a display panel 3 and a controller driver 10. The display device 1 may be configured to provide a user with information on the display panel 3. The display device 1 may be one example of an electronic appliance equipped with a display panel. The electronic appliance may be a portable electronic appliance such as a smart phone, a laptop computer, a netbook computer, a tablet, a web browser, an electronic book reader, and a personal digital assistant (PDA). The electronic appliance may be a device of any size and shape, such as a desktop computer equipped with a display panel, and a display unit mounted on an automobile equipped with a display panel. The electronic appliance may include a touch sensor for touch sensing of an input object such as a user's finger and stylus.

The display panel 3 includes a display area in which an image is displayed. A plurality of pixels is arrayed in rows and columns in the display area of the display panel 3. In one or more embodiments, each pixel includes subpixels configured to display red (R), green (G) and blue (B), respectively. In other embodiments, the colors displayed by the subpixels in each pixel are not limited to red (R), green (G) and blue (B). The colors of subpixels and the number of colors may be modified. In one or more embodiments, an OLED display panel, which is a sort of self-luminous display panel, is used as the display panel 3. In one or more embodiments, the display panel 3 includes gate line drive circuitry 31 and emission drive circuitry 32. The gate line drive circuitry 31 may be configured to drive gate lines of the display panel 3 based on gate line control signals received from the controller driver 10. The emission drive circuitry 32 may be configured to drive emission lines of the display panel 3 based on the emission pulse received from the controller driver 10.

In one embodiment, the controller driver 10 operates as a controller performing various controls in the display device 1, as well as a display panel driver that drives the display panel 3.

In one or more embodiments, the controller driver 10 includes command control circuitry 11, an image memory 12, gamma curve control circuitry 13, data line drive circuitry 14, a DAC controller 15, gate line control circuitry 16 and pulse control circuitry 17.

In one or more embodiments, the command control circuitry 11 is configured to receive control signals, image data and a DBV from the processing unit 2. The command control circuitry 11 may be configured to forward the received image data to the image memory 12. The command control circuitry 11 may be configured to control circuitry integrated in the controller driver 10 in response to the received control signals and the DBV. The command control circuitry 11 may be configured to supply a curve control signal and a brightness control signal, which are used for gamma correction to be performed by the gamma curve control circuitry 13. The command control circuitry 11 may be configured to control the analog signal voltage amplitude of a DAC by sending a DAC top voltage control signal and a DAC bottom voltage control signal to the DAC controller 15. The command control circuitry 11 may be configured to control the gate line control circuitry 16 by outputting the gate line control signals to the gate line control circuitry 16 based on the received control signals. The command control circuitry 11 may be configured to control the pulse control circuitry 17 by outputting the emission pulse control signal to the pulse control circuitry 17 based on the received control signals and DBV.

In one or more embodiments, the command control circuitry 11 includes a brightness control table 111 and is configured to control the display brightness level based on the DBV. In one embodiment, the display brightness control is achieved by the brightness control table 111, the gamma curve control circuitry 13, the DAC controller 15 and the pulse control circuitry 17.

In one or more embodiments, the image memory 12 is configured to temporarily store the image data received from the processing unit 2 via the command control circuitry 11. In various embodiments, the image memory 12 has a capacity sufficient for storing image data corresponding to at least one frame image. In other embodiments, the image memory 12 has a capacity sufficient for storing image data corresponding to at least a portion of an image frame. In one embodiment, when V×H pixels are disposed in the display area of the display panel 3 and each pixel includes three subpixels, image data describing the grayscale values of the V×H×3 subpixels are stored in the image memory 12.

In one or more embodiments, the gamma curve control circuitry 13 is configured to perform the gamma correction on the image data received from the image memory 12, based on correction control signal received from the command control circuitry 11. The gamma curve control circuitry 13 may be configured to supply the corrected image data to the data line drive circuitry 14. The gamma curve control circuitry 13 may be configured to achieve the gamma correction through a Bezier calculation, which involves repeatedly performing selection of at least three control points and calculation of midpoints. Additionally, the gamma curve control circuitry 13 may be configured to generate a gamma curve for a desired DBV such as 50% display brightness value other than the maximum DBV.

In one or more embodiments, the data line drive circuitry 14 is configured to drive the data lines of the display panel 3 in response to the image data received from the gamma curve control circuitry 13. The data line drive circuitry 14 may include a shift register 141, a display latch 142, a DAC 143 and a data line amplifier 144. The shift register 141 may be configured to perform shift operation on the image data received from the gamma curve control circuitry 13. The display latch 142 may be configured to successively latch the image data outputted from the shift register 141 and temporarily store the latched image data.

In one or more embodiments, the DAC 143 is configured to generate drive voltages corresponding to the grayscale values of respective subpixels specified in the image data received from the display latch 142, by performing digital-analog conversion on the received image data. The DAC 143 may be configured to drive the data lines of the display panel 3 by outputting the generated drive voltages to the corresponding data lines via the data line amplifier 144. Grayscale voltages supplied from the DAC controller 15 may be used to generate the drive voltages. In one or more embodiments, grayscale voltages V0 to V1023 are supplied from the DAC controller 15. The DAC 143 may be configured to select the drive voltages from among the grayscale voltages V0 to V1023 in accordance with the grayscale values described in the image data received from the display latch 142. In one or more embodiments, the top voltage of the DAC is the grayscale voltage V0, which corresponds to a grayscale value of "0", and the bottom voltage of the DAC is the grayscale voltage V1023, which corresponds to a grayscale value of "1023".

Figure 4:
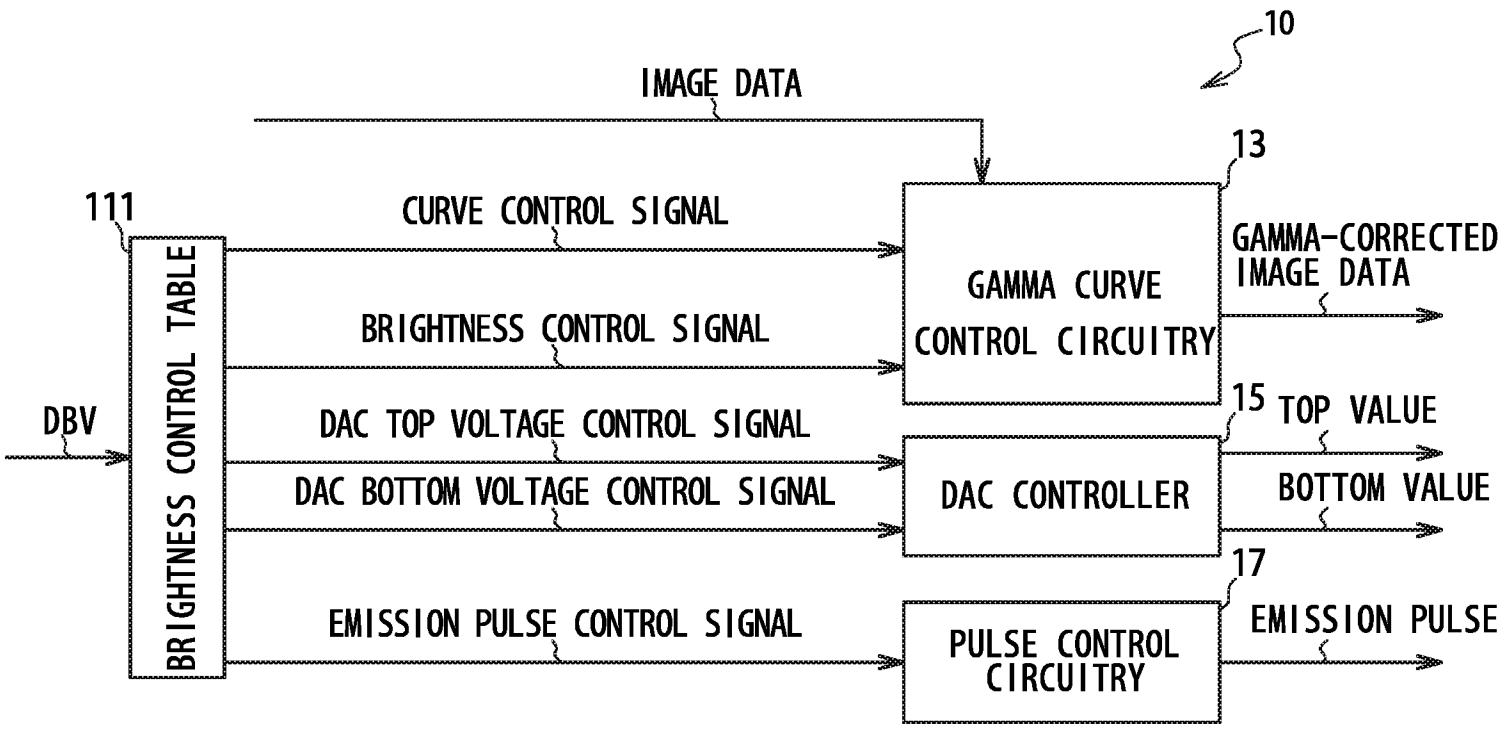
FIG. 4 illustrates an example configuration for display brightness level control in the display device, according to one or more embodiments.

In one or more embodiments, as illustrated in FIG. 4, the display brightness control is performed by the brightness control table 111, the gamma curve control circuitry 13, the DAC controller 15 and the pulse control circuitry 17.

The brightness control table 111 may supply various parameters to the gamma curve control circuitry 13, the DAC controller 15 and the pulse control circuitry 17.

Figure 5:
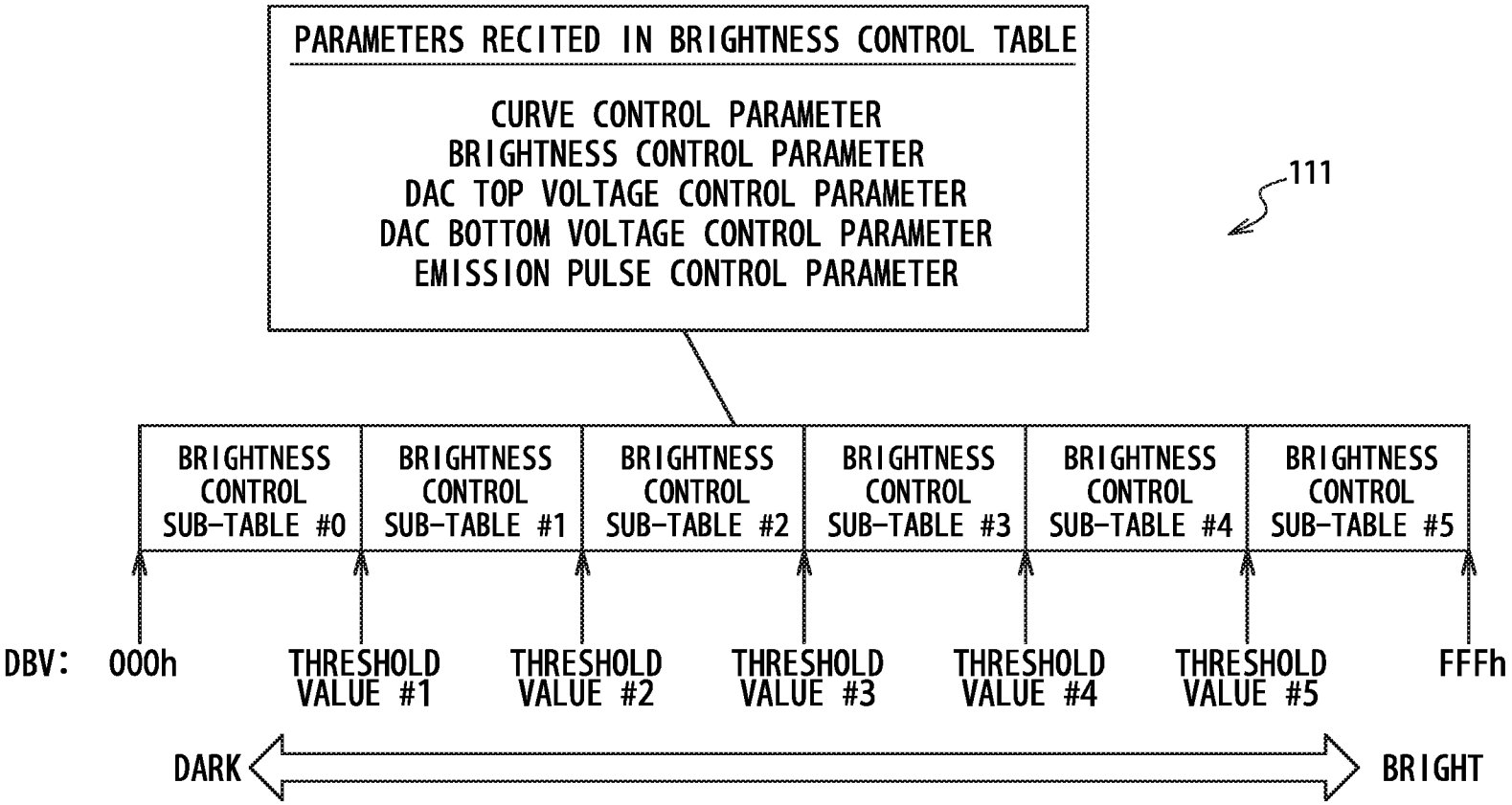
FIG. 5 illustrates an example brightness control table, according to one or more embodiments.

FIG. 5 illustrates one example of the contents of the brightness control table 111, according to one or more embodiments. The DBV may specify the display brightness level with a value ranged from "000" to "FFF" in the hexadecimal notation. In one embodiment, the value "FFF" of the DBV indicates the maximum display brightness level, which is the brightest state, and the value "000" indicates the minimum display brightness level, which is the darkest state.

In one embodiment, as the display brightness value DBV is reduced from "FFF" to "000", the displayed image is made darker, that is, the display brightness level is reduced. In the embodiment of FIG. 5, six sections are defined in the value range of the display brightness value DBV from "000" to "FFF", and one brightness control sub-table is provided for each section. The number of sections defined for the display brightness value DBV may not be limited to six. For example, the number of sections may be any integer equal to two or more. In one embodiment, one of the brightness control sub-tables is selected in response to the inputted display brightness value DBV. In one embodiment of the brightness control sub-table #1 is selected when the display brightness value DBV is a value between threshold value #1 and threshold value #2.

In one or more embodiments, each brightness control sub-table comprises, as parameters, a curve control signal, a brightness control signal, a DAC top voltage control signal, a DAC bottom voltage control signal and an emission pulse control signal. The curve control signal may comprise a parameter used for adjusting the gamma curve to match a desired gamma value. The brightness control signal may comprise a parameter used for adjusting the gamma curve to control the display brightness level. For example, the brightness control signal may be a parameter specifying a distance of a shift of the gamma curve in a direction along the axis which represents the output voltage of the DAC 143. The DAC top voltage control signal and the DAC bottom voltage control signal may comprise parameters specifying the top voltage and the bottom voltage of the analog signal voltage range of the DAC 143, respectively. The emission pulse control signal may comprise a parameter specifying the light emitting time or the light extinction time of pixels of the display panel 3. In one or more embodiments, the emission pulse control signal may comprise a parameter specifying, for example, the ratio of the light emitting time to one frame period. Alternatively, the emission pulse control signal may comprise a parameter specifying, for example, the ratio of the light extinction time to one frame period or the time duration of the light emitting time.

Referring back to FIG. 4, the gamma curve control circuitry 13 may calculate a gamma curve using the curve control signal and the brightness control signal included in the brightness control sub-table selected based on the display brightness value DBV and perform gamma correction on the input image data in accordance with the calculated gamma curve. The gamma curve control circuitry 13 may output the gamma-corrected image data to the data line drive circuitry 14.

In one or more embodiments, the DAC controller 15 is configured to output the top value and bottom value of the analog signal voltage amplitude of the DAC 143 based on the DAC top voltage control signal and the DAC bottom voltage control signal included in the brightness control sub-table selected based on the display brightness value DBV. Further, the DAC controller 15 may adjust the analog signal voltage amplitude of the DAC 143 to match the range of the output voltage generated in accordance with the gamma curve.

In one or more embodiments, the pulse control circuitry 17 is configured to output an emission pulse adjusted based on the emission pulse control signal included in the brightness control sub-table selected based on the display brightness value DBV, to the emission drive circuitry 32. In such an embodiment, the light emitting time of the pixels of the display panel 3 is controlled. In one or more embodiments, the pulse control circuitry 17 is configured to maintain the setting of the light emitting time, when the DAC controller 15 adjusts the analog signal voltage amplitude of the DAC 143. For example, the pulse control circuitry 17 is configured to reduce the light emitting time when the gamma curve control circuitry 13 generates a gamma curve for a display brightness value other than the maximum display brightness value. In one embodiment, the display brightness value other than the maximum display brightness value may be any value in a range from about 0% to about 99% of the maximum display brightness value.

In one or more embodiments, the gamma curve control circuitry 13 achieves the gamma correction through the scheme described below. In one or more embodiments, a Bezier calculation is performed based on three control points (CP) to obtain three control points to be used in the next Bezier calculation. This provides smoothness for the gamma curve. The Bezier calculation may be repeated a predetermined number of times to obtain the output voltage corresponding to the input data. In such an embodiment, the control points may be shifted along both of the X axis, which represents the input data, and the Y axis, which represents the output voltage.

Figure 6:
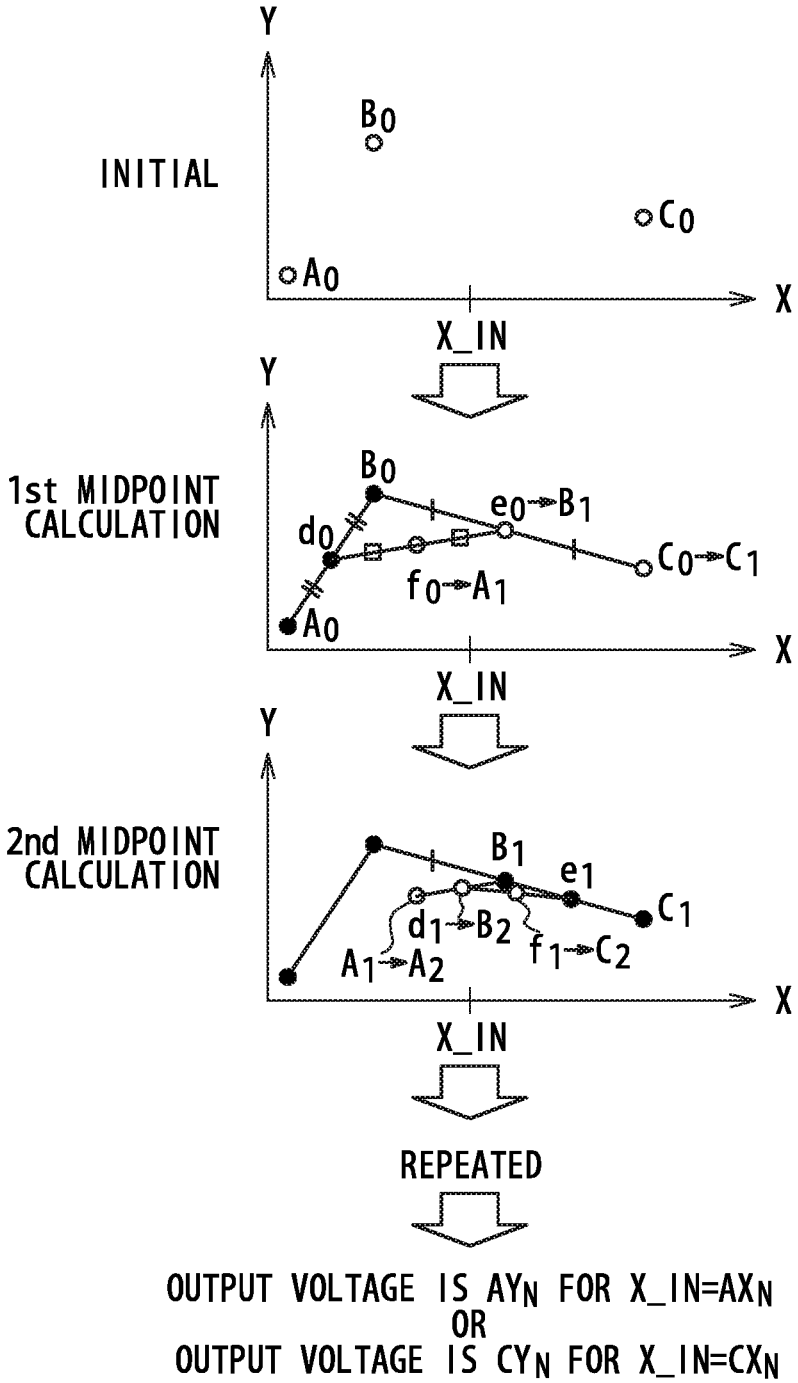
FIG. 6 illustrates example gamma correction, according to one or more embodiments.

In one or more embodiments, as illustrated in FIG. 6, three control points initially selected by the gamma curve control circuitry 13 are illustrated as control points A0, B0 and C0. When the control points CP(2j−2), CP(2j−1) and CP(2j) are initially selected as the control points A0, B0 and C0 from among the control points CP0 to CPm, the coordinates of the control points A0, B0 and C0 are represented as follows:

$$A_0(AX_0,AY_0)=(CPX_{2j-2},CPY_{2j-2}),$$

$$B_0(BX_0,BY_0)=(CPX_{2j-1},CPY_{2j-1}), \text{ and}$$

$$C_0(CX_0,CY_0)=(CPX_{2j},CPY_{2j}),$$

where $CPX_k$ is the X coordinate of the control point $CP_k$ and $CPY_k$ is the Y coordinate of the control point $CP_k$.

In various embodiments, the output voltage is calculated by repeatedly performing calculation of midpoints as described below. This repeated calculation is hereinafter referred to as midpoint calculation. In the following, the midpoint of adjacent two of the three control points may be referred to as the first order midpoint and the midpoint of two first order midpoints may be referred to as the second order midpoint.

The first midpoint calculation is performed with respect to the initially selected three control points $A_0$, $B_0$ and $C_0$, to calculate a first order midpoint do which is the midpoint of the control points $A_0$ and $B_0$, and a first order midpoint $e_0$ which is the midpoint of the control points $B_0$ and $C_0$, and to further calculate a second order midpoint $f_0$ which is the midpoint of the first order midpoint $d_0$ and the first order midpoint $e_0$. The second order midpoint $f_0$ may be positioned on the gamma curve of interest, that is, the second order Bezier curve may be defined by the three control points $A_0$, $B_0$ and $C_0$. In this case, the coordinates ($X_{f0}$, $Y_{f0}$) of the second order midpoint $f_0$ are represented by the following expressions:

$$X_{f0}=(AX_0+2BX_0+CX_0)/4, \text{ and}$$

$$Y_{f0}=(AY_0+2BY_0+CY_0)/4.$$

The three control points $A_1$, $B_1$ and $C_1$ used in the next midpoint calculation, that is, the second midpoint calculation, are selected from among the control point $A_0$, the first order midpoint $d_0$, the second order midpoint $f_0$, the first order midpoint $e_0$ and the control point $B_0$, based on comparison between the input grayscale value and the X coordinate $X_{f0}$ of the second order midpoint $f_0$. More specifically, the control points $A_1$, $B_1$ and $C_1$ are selected as follows, where X_IN is the input grayscale value:

(A) When $X_{f0} \geq$ X_IN

The three leftmost points which have smaller X coordinates, that is, the control point $A_0$, the first order midpoint do and the second order midpoint $f_0$ are selected as the control points $A_1$, $B_1$ and $C_1$. In other words, $$A_1=A_0,\ B_1=d_0, \text{ and } C_1=f_0. \tag{1a}$$

(B) When $X_{f0}<$ X_IN

The three rightmost points which have larger X coordinates, that is, the second order midpoint $f_0$, the first order midpoint $e_0$ and the control point $C_0$ are selected as the control points $A_1$, $B_1$ and $C_1$. In other words, $$A_1=f_0,\ B_1=e_0, \text{ and } C_1=C_0. \tag{1b}$$

The second midpoint calculation is performed in a similar manner. The second midpoint calculation is performed with respect to the control points $A_1$, $B_1$ and $C_1$, to calculate the first order midpoint $d_1$ of the control points $A_1$ and $B_1$, the first order midpoint $e_1$ of the control points $B_1$ and $C_1$, and to further calculate the second order midpoint $f_1$ of the first order midpoint $d_1$ and the first order midpoint $f_1$. The second order midpoint $f_1$ may be positioned on the gamma curve of interest. Furthermore, three control points $A_2$, $B_2$ and $C_2$ may be used in the next midpoint calculation, that is, the third midpoint calculation, are selected from the control point $A_1$, the first order midpoint $d_1$, the second order midpoint $f_1$, the first midpoint $e_1$ and the control point $B_1$, based on comparison between the input grayscale value X_IN indicated by an input data and the X coordinate $X_{f1}$ of the second order midpoint $f_1$.

In various embodiments, the midpoint calculation is repeated a desired number of times in a similar manner.

In summary, in one or more embodiments, the following operation is performed in the ith midpoint calculation.

(A) When $(AX_{i-1}+2BX_{i-1}+CX_{i-1})/4 \geq$ X_IN $$AX_i=AX_{i-1}, \tag{2a}$$

$$BX_i=(AX_{i-1})/2, \tag{3a}$$

$$CX_i=(AX_{i-1}+2BX_{i-1}+CX_{i-1})/4, \tag{4a}$$

$$AY_i=AY_{i-1}, \tag{5a}$$

$$BY_i=(AY_{i-1}+BY_{i-1})/2, \text{ and} \tag{6a}$$

$$CY_i=(AY_{i-1}+2BY_{i-1})/4. \tag{7a}$$

(B) When $(AX_{i-1}+2BX_{i-1}+CX_{i-1})/4<$ X_IN $$AX_i=(AX_{i-1}+2BX_{i-1}+CX_{i-1})/4, \tag{2b}$$

$$BX_i=(BX_{i-1}+CX_{i-1})/2, \tag{3b}$$

$$CX_i=CX_{i-1}, \tag{4b}$$

$$AY_i=(AY_{i-1}+2BY_{i-1}+CY_{i-1})/4, \tag{5b}$$

$$BY_i=(BY_{i-1}+CY_{i-1})/2, \text{ and} \tag{6b}$$

$$CY_i=CY_{i-1}. \tag{7b}$$

In various embodiments, the equality sign may be attached to any one of the inequality signs of the conditions (A) and (B).

In one embodiment, when the midpoint calculation is performed, the control points Ai, Bi and Ci are made closer to the gamma curve and the X coordinates of the control points Ai, Bi and Ci are made closer to the input grayscale value. The voltage value of the output voltage may be finally obtained from the Y coordinate of at least one of the control points AN, BN and CN, which are obtained by the Nth midpoint calculation. In one or more embodiments, the Y coordinate of a selected one of the control points AN, BN and CN may be selected as the output voltage. Alternatively, the average of the Y coordinates of the control points AN, BN and CN may be selected as the output voltage.

In one or more embodiments, the number N of times of the midpoint calculation is equal to or more than the number of bits of the input grayscale value. In one or more embodiments, the midpoint calculation is performed N times or more, when the input grayscale value is an N-bit data. In this case, the difference between the X coordinates of the control points AN and CN becomes one, and the X coordinate of one of the control points AN and CN is made equal to the input grayscale value. Meanwhile, the X coordinate of the control point BN is also made equal to the X coordinate of one of the control points AN and CN. In view of this, in one or more embodiments, output voltage is selected as follows:

(a) When X_IN=AXN, Y_OUT=AYN.

(b) When X_IN=CXN, Y_OUT=CYN.

Figure 7A:
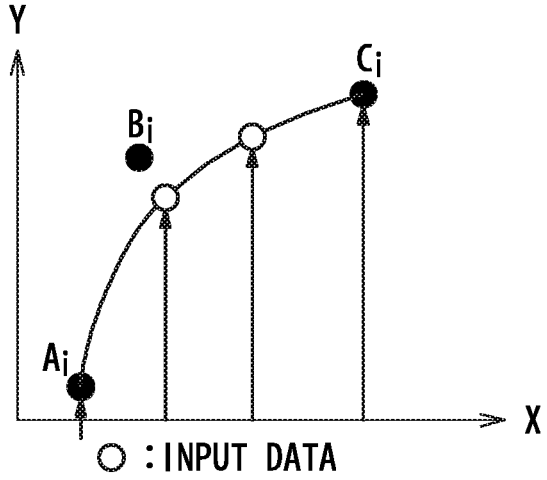
FIGS. 7A and 7B illustrate example relations between input data and control points in gamma correction, according to one or more embodiments.
Figure 7B:
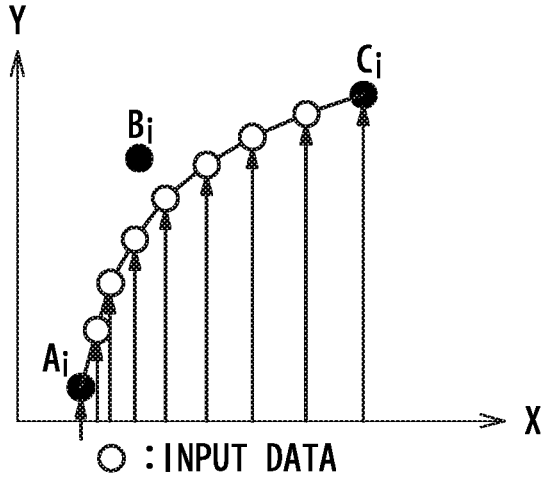

In one or more embodiments, the intervals between the control points Ai, Bi and Ci may be inconstant. This allows obtaining coordinates of a desired point on the gamma curve for coarse input data or a reduced number of input data as illustrated in FIG. 7A or for fine input data or an increased number of input data as illustrated in FIG. 7B.

As described above with reference to FIG. 1, the display brightness level may be reduced from 100% to 50% with the gamma value kept constant, by multiplying the input data by 186/255. In such embodiments, however, a part of input grayscale values cannot be used to reproduce the display image, and this may cause grayscale collapse.

Accordingly, in one or more embodiments, the method described below is used to generate a gamma curve for a reduced brightness level of the display data with the gamma value kept constant.

In one embodiment, calculating the gamma curve for the display brightness level of 50% by multiplying the input grayscale value by 186/255 results in reduction in the number of the grayscale levels representable by the output voltage. In one or more embodiments, the X coordinates of the control points are multiplied by 255/186. As such, a gamma curve for the display brightness level of 50% may be generated without reducing the number of grayscale levels representable by the output voltage. Although the example in which the gamma curve for the display brightness level of 50% is generated has been described in the above, the display brightness level is not limited to 50%. A gamma curve may be generated for any desired display brightness level in a similar manner.

Although a limited number of embodiments have been described in the above, a skilled person benefitted from this disclosure would appreciate that various other embodiments and variations may be conceived without departing from the scope of this disclosure. Embodiments and variations may be combined. Accordingly, the specification and drawings only provides an exemplary disclosure.

What is claimed is:

1. A method of displaying an image, comprising:

receiving a display brightness value ("DBV") for displaying the image;

selecting, based at least in part on the DBV, a display mode for the image from a set of pre-defined display modes, wherein each display mode has a corresponding brightness level, and all display modes have N grayscale levels, where N is an integer, and wherein each of the display modes in the set of pre-defined display modes is used to display image data on a same set of pixels of a display panel; and displaying the image on the display panel according to a pre-defined gamma value and at least one control parameter corresponding to the display mode.

2. The method of claim 1, wherein selecting the corresponding display mode includes selecting a brightness control sub-table entry from a brightness control table.

3. The method of claim 2, wherein the brightness control sub-table entries respectively corresponding to the value of the at least one control parameter.

4. The method of claim 1, wherein the at least one control parameter is a set of control parameters including at least two of the following:

a curve control parameter, a brightness control parameter, a digital to analog controller (DAC) top voltage control parameter, a DAC bottom voltage control parameter, and an emission pulse control parameter.

5. The method of claim 1, wherein displaying the image on the display panel further includes generating a gamma curve, using the pre-defined gamma value, corresponding to the selected display mode.

6. The method of claim 1, wherein the set of pre-defined display modes varies as to a range of voltage between a top output voltage level and a bottom output voltage level of a DAC coupled to the display panel.

7. The method of claim 6, wherein the N grayscale levels are analog input voltage levels of the DAC.

8. The method of claim 1, wherein the set of display modes comprises normal display modes and high brightness display modes.

9. The method of claim 8, wherein at least one of:

the normal display modes have an emission pulse duty ratio between 25% and 50%, and wherein the high brightness display modes have an emission pulse duty ratio between 50% and 99%; or the normal display modes each have a first analog signal voltage amplitude ("ASVA") and the high brightness display modes each have a second ASVA, the second ASVA larger than the first ASVA.

10. The method of claim 8, wherein the normal display modes each have a first DAC bottom voltage and the high brightness display modes each have a second DAC bottom voltage, the second DAC bottom voltage lower than the first DAC bottom voltage.

11. The method of claim 1, wherein the pre-defined gamma value is 2.2, and wherein N=256.

12. The method of claim 1, wherein the set of pre-defined display modes varies as to emission pulse duty ratio.

13. A display driver, comprising:

control circuitry configured to:

receive a display brightness value ("DBV") and control signals for displaying an image;

select, based at least in part on the DBV, a display mode for the image from a set of pre-defined display modes, wherein each display mode has a corresponding brightness level, and all display modes have N grayscale levels, where N is an integer, and wherein each of the display modes in the set of predefined display modes is used to display image data on a same set of pixels of a display panel; and display the image on the display panel according to a pre-defined gamma value and at least one control parameter corresponding to the display mode.

14. The display driver of claim 13, further comprising a memory coupled to the control circuitry, wherein a brightness control table is stored in the memory.

15. The display driver of claim 14, wherein selecting the display mode from the set of pre-defined display modes includes selecting a brightness control sub-table entry from the brightness control table.

16. The display driver of claim 13, wherein the at least one control parameter is a set of control parameters including at least two of the following:

a curve control parameter, a brightness control parameter, a digital to analog controller (DAC) top voltage control parameter, a DAC bottom voltage control parameter, and an emission pulse control parameter.

17. The display driver of claim 13, wherein the set of display modes is divided into normal display modes and high brightness display modes, and wherein at least one of:

the normal display modes have an emission pulse duty ratio between 25% and 50%, and wherein the high brightness display modes have an emission pulse duty ratio between 50% and 99%; or the normal display modes each have a first analog signal voltage amplitude ("ASVA") and the high brightness display modes each have a second ASVA, the second ASVA larger than the first ASVA.

18. A display device, comprising:

a display panel; and a display driver configured to drive the display panel, wherein the display driver comprises:

control circuitry configured to:

receive a display brightness value ("DBV") and control signals for displaying an image;

select, based at least in part on the DBV, a display mode for the image from a set of pre-defined display modes, wherein each display mode has a corresponding brightness level, and all display modes have N grayscale levels, where N is an integer, and wherein each of the display modes in the set of predefined display modes is used to display image data on a same set of pixels of the display panel; and display the image on the display panel according to a pre-defined gamma value and at least one control parameter corresponding to the display mode.

19. The display device of claim 18, further comprising a DAC coupled to the control circuitry and to the display panel, wherein the set of pre-defined display modes varies as to at least one of:

a range of voltage between a top output voltage level and a bottom output voltage level of the DAC; or emission pulse duty ratio.

20. The display device of claim 18, wherein the set of display modes is divided into normal display modes and high brightness display modes.

21. The display device of claim 20, wherein the normal display modes each have a first DAC bottom output voltage and the high brightness display modes each have a second DAC bottom output voltage, the second DAC bottom output voltage lower than the first DAC bottom output voltage.

* * * * *